US006406071B1

(12) United States Patent
LaViola et al.

(10) Patent No.: US 6,406,071 B1
(45) Date of Patent: Jun. 18, 2002

(54) TWO-PIECE FLEXIBLE LATCH AND HANDLE HAVING ADJUSTABLE LENGTHS

(75) Inventors: James A. LaViola, Middle Smithfield Township, Monroe County; Salvatore P. J. Vito, Stroudsburg Township, Monroe County, both of PA (US)

(73) Assignee: Elastolatch, Inc., East Stroudsburg, PA (US)

( * ) Notice: Subject to any disclaimer, the term of this patent is extended or adjusted under 35 U.S.C. 154(b) by 0 days.

(21) Appl. No.: 09/521,006

(22) Filed: Mar. 7, 2000

Related U.S. Application Data

(60) Provisional application No. 60/123,417, filed on Mar. 9, 1999.

(51) Int. Cl.[7] ..... E05C 19/10

(52) U.S. Cl. ..... 292/102; 292/87; 292/101; 16/441

(58) Field of Search ..... 16/441; 292/81, 292/87, 96, 101, 102, DIG. 69

(56) References Cited

U.S. PATENT DOCUMENTS 21,968 A * 11/1858 Judd ..... 292/87
120,533 A * 10/1871 Pool et al. ..... 292/101
170,792 A * 12/1875 White et al. ..... 126/289
197,390 A * 11/1877 Mix ..... 292/102
289,666 A * 12/1883 Lee ..... 292/127
764,493 A * 7/1904 Noseworthy ..... 292/87
1,782,386 A * 11/1930 Moore et al. ..... 292/169.21
6,195,840 B1 * 3/2001 Pilatowicz et al. ..... 16/441

* cited by examiner

*Primary Examiner*—Teri Pham Luu
(74) *Attorney, Agent, or Firm*—Kenneth P. Glynn, Esq.

(57) ABSTRACT

A latch mechanism having a flexible catch attached to a base with a centering disk for cooperative self-alignment with the door through which the latch mechanism is to be inserted and a shaft having a plurality of retention disks at spaced apart locations on the shaft is preferably molded into a single piece construction for cooperative combination with a handle (or knob) which is preferably molded in two sections and connected by a flexible hinge such that each section is a mirror image of the other. Each handle section has arrayed along its centerline a series of receivers for the plurality of disks on the latch shaft such that the disks are captured and retained in the receivers when the two sections of the handle are folded over onto one another and snap locked in place by cooperating projections and receivers positioned in opposing positions on each section of the handle.

20 Claims, 6 Drawing Sheets

TWO-PIECE FLEXIBLE LATCH AND HANDLE HAVING ADJUSTABLE LENGTHS

REFRENECE TO RELATED CASES

This is a continuation-in-part of U.S. pending patent application Ser. No. 60/123,417, filed on Mar. 9, 1999, and entitled "Two-Part Flexible Latch and Handle with Adjustable Length Shaft", by the same inventors herein.

BACKGROUND OF THE INVENTION

The present invention deals with flexible latch mechanisms in which the latch moves away from and springs back against a keeper or strike plate to retain the door, or other object to be retained, in a closed position. The invention also deals with the adjustability of the latch to accommodate different depths of doors, or other objects, and the capacity to retain the latch and handle (or knob) on the door during normal usage.

There are presently a number of latch mechanisms which are used on both large and small doors (or other objects) which are positioned at time of manufacture of the larger apparatus, e.g. internal doors on vending machine apparatus for dispensing foodstuffs, clothes washing and drying, etc. Usually these latch mechanisms are separate from the handle or knob which is utilized to operate the door or other object desired to be moved or retained in position. With separate latch mechanisms and handles, the doors are subject to damage by the exertion of a pulling force at points across the extent of the door which produces an unequal force on the latch mechanism which will lead to damage, and potential failure, of the latch. Alternatively, the handle, from the exertion of unequal forces, may fail by being pulled away from the door or other object. Thus, it is an object of the present invention to align the forces so that potential for failure of either part is significantly reduced.

It is also an object of the present invention to combine the latch mechanism and handle (or knob) into a single unit by utilizing a two-part apparatus which conjoins at installation to make a single latch and handle unit.

It is a further object of the present invention to provide a flexible latch mechanism which mates with a handle (or knob) such that the shaft of the latch which extends through the door (or other object) aligns with and is captured by a handle having cooperating receivers for each of a plurality of disks on the shaft of the latch mechanism. The handle captures the shaft disks by folding one part of the handle over onto a mirror duplicate part, utilizing a flexible hinge between the two parts of the handle, and retaining the two parts of the handle in a juxtaposed, closed position by snapping two or more retention projections on one portion of the handle into cooperating receivers on the other portion.

It is yet another object of the present invention to provide a mechanism to automatically self-center, and retain centering, of the latch and handle combination on the door or other object.

It is still another object to utilize the combination latch and handle apparatus of the present invention as a retrofit to an existing door of a vending apparatus, or other object, such as to provide a replacement closure mechanism for the original closure mechanism.

It is a still further object of the present invention to provide a combination latch and handle apparatus which is adjustable to the thickness of the door or other object through which it is inserted to create a tight fit for apparatus integrity with the door.

Other objects will appear hereinafter.

1. Field of the Invention

The present invention relates to two-piece flexible latch and handle having adjustable lengths, which offers enhanced supplicity in both the manufacturer of the components and their installation. The present invention devices are each constructed to permit installation with doors of a variety of thicknesses.

2. Information Disclosure Statement

Latches of different types have been used for hundreds of years to secure doors and come in many shapes, forms and functionalities. Today, handle and latch arrangements are used on sheds, electrical boxes, gates, appliance doors such as washers and dryers, vending machines and many other applications and are made of metal or plastic or combinations of these and typically involve assemblage of more than two parts with bolts and nuts or screws. Additionally, they are either designed for a single thickness door, or can only accommodate different thicknesses by adjustments of two or more bolts and nuts. These devices usually require four or five parts, have diverse manufacturing requirements and are more complex to assemble than the present invention devices.

Thus, the present invention devices provide for manufacturer with only two molds and utilize a single material of construction, i.e. with polymers and, especially with elastomeric polymers.

SUMMARY OF THE INVENTION

The present invention resides in the field of self-aligning two-part combination flexible closure mechanisms and includes a latch portion and a handle portion which cooperate to provide a self-locking latch and handle which is insertable through an internal door (or other object) in a vending apparatus, i.e. for foodstuffs or for laundering clothes, etc., and which is adjustable to accommodate differing depths of doors in area of the intended use. A latch mechanism having a flexible catch attached to a base having a centering disk for cooperative self-alignment with the door through which the latch mechanism is to be inserted and a shaft having a plurality of retention disks at spaced apart locations on the shaft is preferably molded into a single piece construction. The handle (or knob) is preferably molded in two sections connected by a flexible hinge such that each section is a mirror image of the other. Each handle section has arrayed along its centerline a series of receivers for the plurality of disks on the latch shaft such that the disks are captured and retained in the receivers when the two sections of the handle are folded over onto one another and snap locked in place by cooperating projections and receivers positioned in opposing positions on each section of the handle. The handle also has a self-centering projection (one-half on each section) which aligns the handle coaxially with the latch when the latch shaft is captured in the retention receivers upon closure and locking of the handle sections. In this manner, the two-part combination latch and handle creates a self-aligning, self-centering, latch and handle having a flexible catch and an adjustable length shaft for insertion through a door (or other object) either as an original, or as a retrofit, latch and handle forming a closure mechanism for the door or other object with a keeper or strike plate against which the catch is positioned.

BRIEF DESCRIPTION OF THE DRAWINGS

The present invention should be more fully understood when the specification herein is taken in conjunction with the drawings appended hereto wherein:

FIG. 5 shows a side cut view of another alternative embodiment present invention two-piece flexible latch and handle installed;

FIGS. 6 through 9*b* show various alignment element arrangements for the present invention device; and, FIG. 10 shows a side partial cut view of another alternative embodiment present invention device wherein the make ratcheting elements are located on the handle portion.

DETAILED DESCRIPTION OF THE PRESENT INVENTION

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
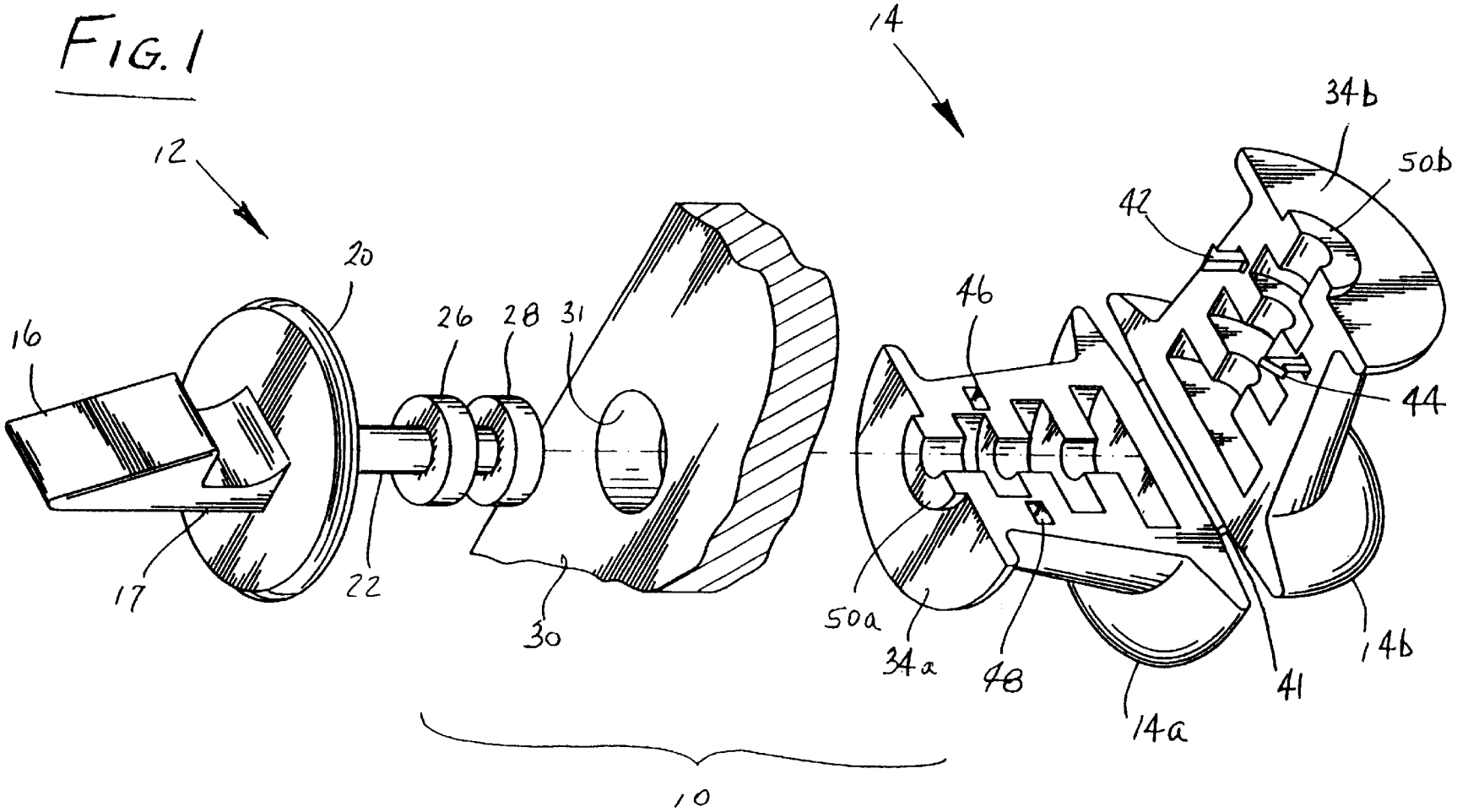
FIG. 1 is a perspective view of the present invention showing the latch portion and separate section of the handle portion exploded outward from a door to which the latch and handle apparatus is to be attached.
Figure 2:
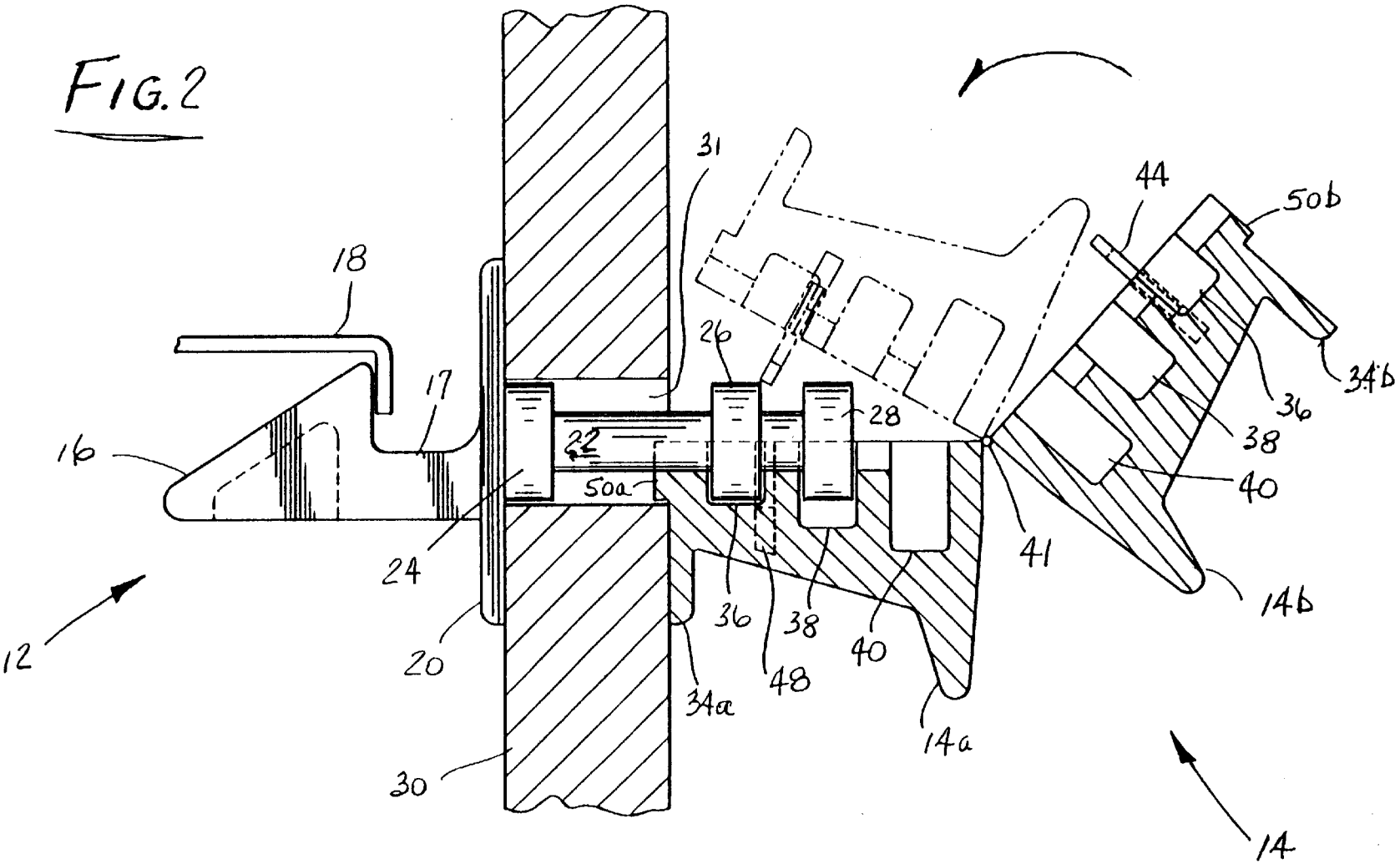
FIG. 2 is a partially cut-away side view of the present invention placed through a door with the shaft adjustment disks of the latch positioned within the receivers of one section of the handle and showing the handle sections rotatable around the flexible hinge for mating and snap closure to retain the shaft within the handle sections and to assist in self-alignment of the overall apparatus.

Referring now to the drawings in detail, wherein like numerals refer to like parts or elements, there is shown in FIGS. 1 and 2 a two-part combination flexible latch and handle apparatus 10 which may be best described by reference to the individual portions, a latch portion 12 and a handle portion 14, as follows. Latch portion 12 has a flexible catch 16 which flexes on its shank 17 toward and away from keeper or strike plate (not shown). The latch portion 12 of the present invention is presently preferred to be molded as a single unit of a flexible polymeric material, which material can retain elastic memory of position and is not susceptible to degradation through frictional contact with the keeper 18. The latch portion also has a base 20 which is depicted as a circular member, but may be formed in any geometric shape or other shape or configuration which provides for the retention of perpendicularity between the flexible catch 16 and the surface of the door 30.

Extending from the back side of the base 20 is a shaft 22 which has positioned along its extent, in a spaced apart array, at least two adjustment disks 26 and 28. These disks 26 and 28 are sized so as to pass through the aperture or opening 31 in the door 30 and be available for capture on the outside of the door. Also, along the back side of the base 20 is a centering disk 24 which positions the latch portion 12, and its shaft 22 and adjustment disks 26 and 28, along the centerline of the opening 31 of the door 30. The centering disk is configured in a cylindrical shape and sized so as to fit snugly within the opening 31 of the door 30.

On the outside of the door 30, the handle portion 16 of the present invention is shown in two sections 14*a* and 14*b* connected by a flexible hinge 41 made of an elastomeric polymer and capable of being flexed about its longitudinal axis without deformation or breaking. Each of the two sections 14*a* and 14*b* of the handle portion 14 are mirror images of the other, and can be described as follows. Each of the sections has a base member 34*a* and 34*b* which fits against the outer surface of the door 30. Along the inner surface of the two sections 14*a* and 14*b* are a series of shaft disk receivers 36, 38 and 40, all of which are sized to accommodate and capture the disks 26 and 28 arrayed along the shaft 22. In the drawing in FIG. 2 the disks 26 and 28 are positioned within, and will be captured by, receivers 36 and 38 when the two sections 14*a* and 14*b* of the handle portion 14 are closed. However, if the depth of the door 30 is reduced to a lesser thickness, the disks 26 and 28 may be positioned in receivers 38 and 40 in order to preserve the integrity of the combination latch and handle and to create as tight fit as possible with the door 30. Each of the receivers 36, 38 and 40 is shaped to exactly configure to the shape of the shaft disks 26 and 28 in order to produce an integral combination handle and latch mechanism 10 when the two sections 14*a* and 14*b* of the handle are closed.

Once the shaft disks 26 and 28 are positioned within the appropriate receivers 36 and 38 (as shown) of one section of the handle 14*a*, the other section 14*b* is rotated about the flexible hinge 41 to the position shown in phantom in FIG. 2. At this point the second half of the receivers 36, 38 and 40 are positioned above the shaft disks 26 and 28 and the snap lock projections 44 and 46 on section 14*b* of the handle are positioned over the same number of projection receivers 46 and 48 located within section 14*a* of the handle. Once the alignment of the receivers, disks and locking projections is accomplished, section 14*b* of the handle 14 is snap fitted onto section 14*a* by locking the projections 42 and 44 into locking receivers 46 and 48. This procedure captures the disks 26 and 28 and retains them in the appropriate receiver 36, 38 (or 40) of the handle portion 14 and snap fits the centering disk 24 into the opening 31. The centering disk 24 is located along the inner face of the base 20 of the handle portion 14 and is divided in two with each half 50*a* and 50*b* located on respective sections 14*a* and 14*b* of the handle or knob 14.

When the process of inserting the latch shaft 22 with the retaining disks 26 and 28 through the opening 31 of the door 30 and into the two sections 14*a* and 14*b* of the handle 14, and more particularly the appropriate disk receivers 36, 38 (or 40), and the locking projections 42 and 44 are engaged with their respective receivers 46 and 48, the latch and handle 10 is fully assembled into an integral combination which exhibits the intended flexibility of the latch and integrity of a single piece construction. Hence, the assembled latch and handle assembly produces a retrofit to an existing door of a vending apparatus, or other object, such as to provide a replacement closure mechanism for the original closure mechanism. Additionally, the combination latch and handle apparatus can be made adjustable to the thickness of the door or other object through which it is inserted to create a tight fit for latch integrity with the door.

Figure 3:
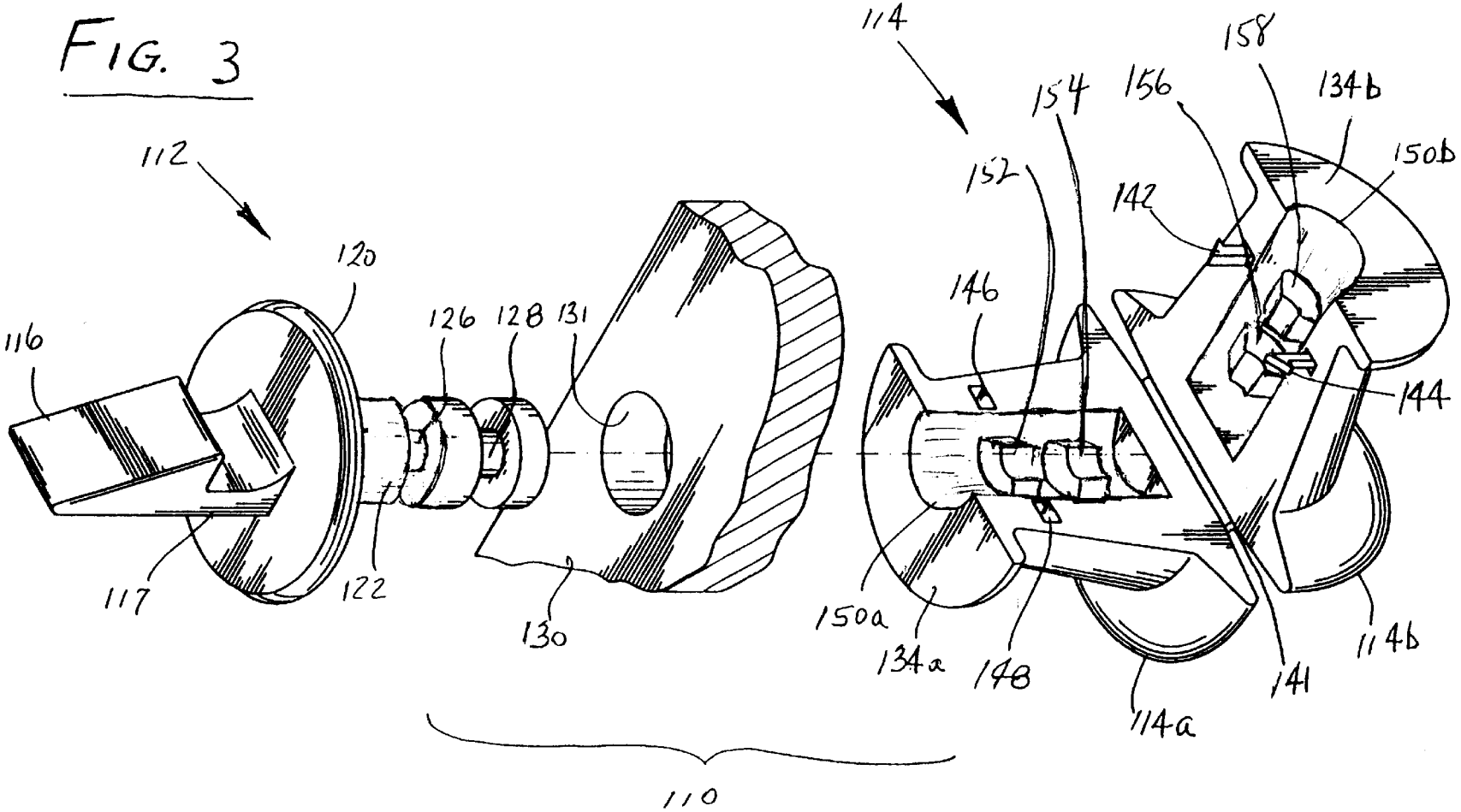
FIG. 3 shows a perspective view of another embodiment of a present invention device.

FIG. 3 shows an alternative embodiment present invention two-part combination flexible latch and handle device 110. In this embodiment, the male and female parts are reversed. Thus, there is a latch portion 112 and a handle portion 114. Latch portion 112 has a flexible catch 116 which flexes on its shank 117 toward or away from a striker plate. The latch portion 112 also has a base 120 with a shaft shown generally as shaft 122. Shaft 122 has two cut-outs for receiving protrusions from handle portion 114. These cut-outs are circular cut-outs and are shown as first locking members cut-outs 126 and 128. There is a portion of a door 130 shown with an opening 131 through which latch portion 112 passes.

Handle portion 114 is divided into two parts. 134*a* and 134*b* with half apertures 150*a* and 150*b*, respectively. There are end knob halves 114*a* and 114*b* as shown with a living hinge connection 141. There are also locking protrusions 142 and 144 which engage with receivers 146 and 148. First portion 134*a* has two protrusions 152 and 154 and first half and second half 134*b* has corresponding second locking members protrusions 156 and 158. Latch portion 112 is passed through opening 131 and then protrusions 152 and 156 are fitted onto either first locking member cut-out 126 or first locking member cut-out 128. This affords a user two different positions. When first half 134*a* and second half 134*b* are brought together, locking protrusions 142 and 144 lock into receivers 146 and 148 to yield an integral combination handle and latch mechanisms in 110 in its assembled form.

Figure 4:
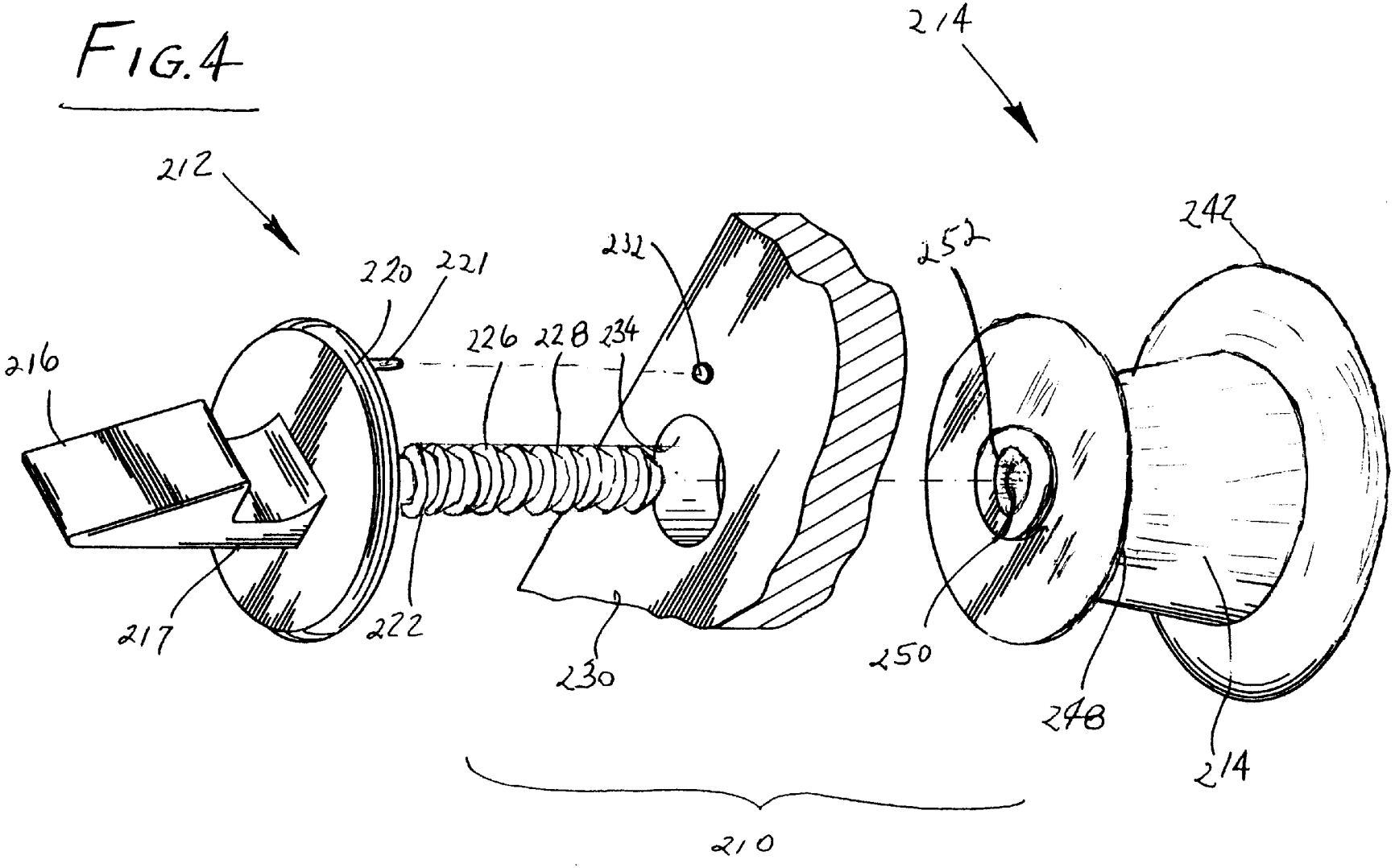
FIG. 4 illustrates a perspective view of another alternative embodiment present invention device utilizing pine tree ratchets on the latch portion.

FIG. 4 shows another alternative embodiment present invention two-part combination flexible latch and handle device 210. It includes latch portion 212 and knob portion 214. In this embodiment, latch portion 212 includes a flexible catch 216 with shank 217 and base 220. In this embodiment, base 220 has an alignment pin 221 which fits into aperture 232 of door 230. Shaft 222 has one-way ratchets sometimes referred to as "pine tree ratchets" such as ratchets 226 and 228. These are truncated conical ratchets which are inserted into orifice 252 of knob portion 214. Stops such as stop 250 located in orifice 252 prevents removal of latch portion 212 from knob portion 214 once at least one ratchet has been inserted therein. Knob portion 214 also includes a base 248, a grasping portion 214 and a crown 242, as shown. Thus, latch portion 212 is inserted into door opening 234 with alignment pin being inserted into aperture 232 for alignment. Shaft 222 inserts into orifice 252 with base 248 flush against one side of door 230 and base 220 flush against the other side of door 230 to create a tight fitting, non-removable, two-piece assembled knob and latch. Because of the plurality of ratchets on shaft 222 and a need to only lock a small number of these ratchets into knob 214, this device will accommodate many door thicknesses.

Figures 5, 6, 7A, 7B, 8, 9A, 9B:
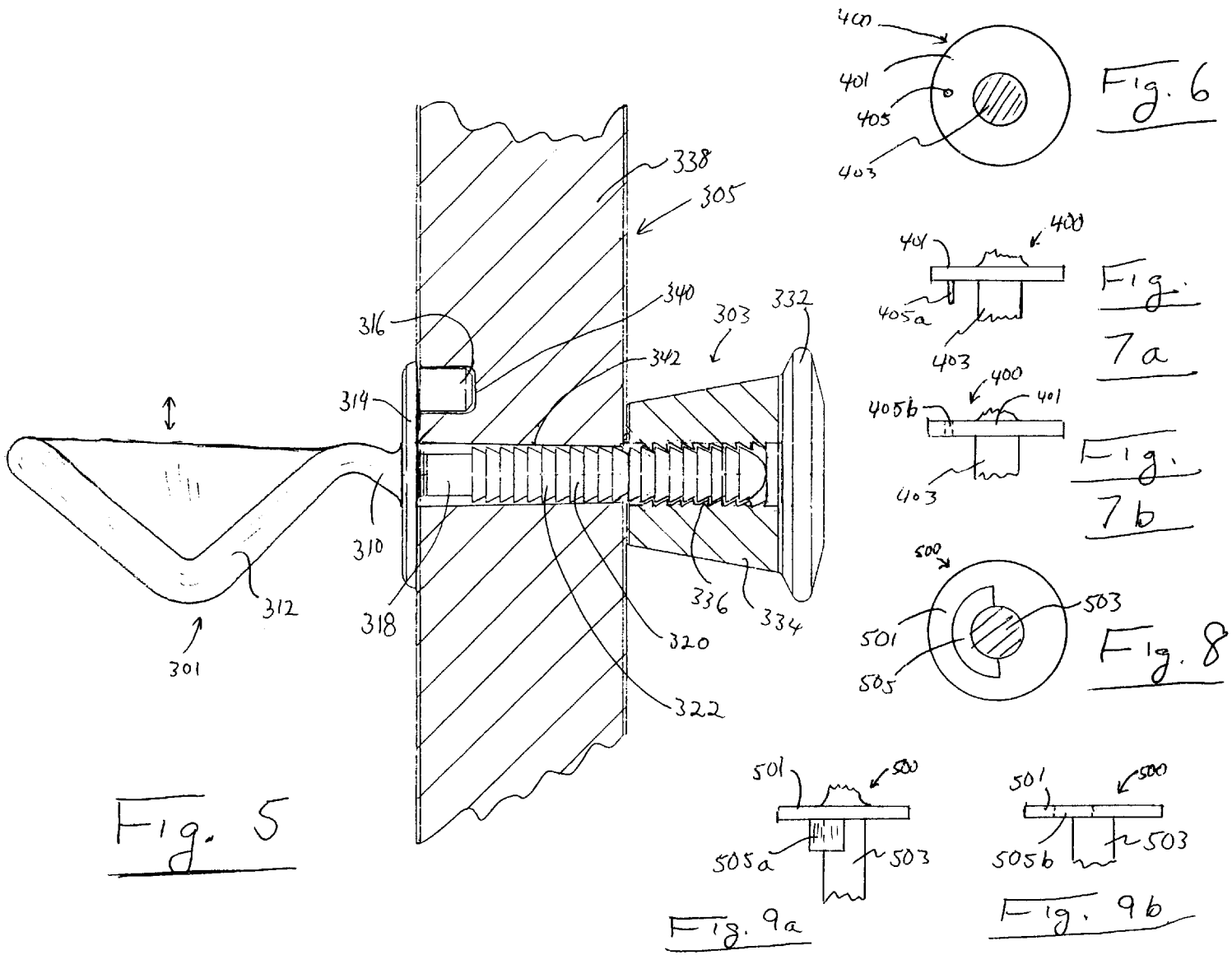

FIG. 5 shows a side cut view of another alternative embodiment present invention twopiece flexible latch and handle installed. In FIG. 5, there is shown a side cut view of present invention flexible latch portion 301 and knob portion 303 attached to door 305. Flexible latch portion 301 includes a flexible catch 312 with a shank 310 and a base 314. Base 314 has an alignment pin 316 which fits into opening 340 which has been formed into core 338 of door 305. Beyond base 314 is shaft 318 with ratchets such as ratchets 320 and 322. Shaft 318 fits through door orifice 342 and into knob portion 303. Knob portion 303 acts as a handle and has a central cylinder 334 and a gripping flange 332. It also has a ratcheted opening 336 to receive the ratchets of shaft 318 in a one way, locking fashion.

FIGS. 6 through 9*b* illustrate various examples of arrangements to achieve proper alignment of a latch portion of a present invention device.

FIG. 6 shows a bottom view of a latch portion 400 having a base 401, a shaft 403 and an orifice 405 for a screw, pin or a protrusion to set the alignment. Alternatively, 405 could represent a protrusion rather than an orifice and would work similar to that shown in FIGS. 4 and 5. FIGS. 7*a* and 7*b* illustrate alternative side views of protrusion/orifice 405 of FIG. 6. Thus, in FIGS. 7*a* and 7*b*, identical parts are identically numbered, except that in FIG. 7*a* there is a protrusion 405*a* and in FIG. 7*b* there is an orifice 405*b*.

FIGS. 8, 9*a* and 9*b* show alternatives to the arrangements shown immediately above.

FIG. 8 shows a bottom cut view of latch portion 500, with a base 501 and a cut shaft 503. There is a semi-circular element 505 which is shown in FIG. 9*a* as protrusion 505*a* and in FIG. 9*b* as a cut-out 505*b*. Otherwise, identical parts are identically numbered. When the FIG. 9*a* version is used, a corresponding semi-circular cut-out will be made with the door to which it is assembled, or a plate with an appropriate cut-out for alignment could be attached to the door. When the FIG. 9*b* version is used, a protrusion on the door or a plate attached to the door with such a protrusion must correspond with cut-out 505*b* for fixing alignment of the shaft.

Figure 10:
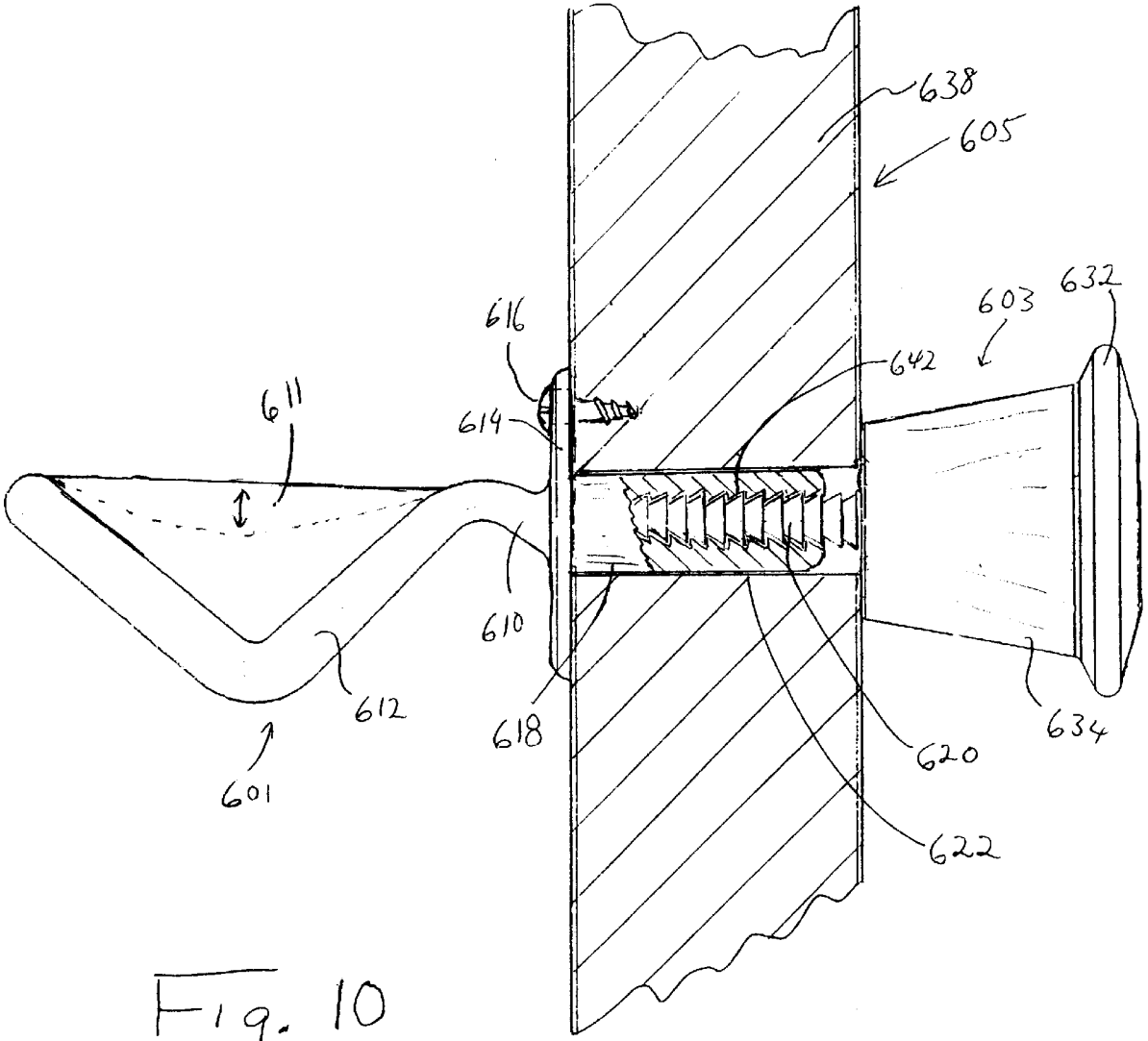

FIG. 10 shows a side cut view of another present invention device with latch portion 601 and handle or knob portion 603. It is shown in a partial cut side view, attached to door 605. Latch portion 601 has a compressible, catch 612 which has a compressible section 611 as shown by the arrow, as well as a shank 610. Its base 614 is screwed into the desired alignment position with screw 616 into door core 638. In this embodiment, it is the latch portion 601 that has the female receiving element and handle or knob portion 603 that has the male insertion element. Thus, latch portion 601 has a hollow shaft 618 with ratchet cut-outs such as cut-out 642 and handle or knob portion 603 has a ratchet shaft 620. They are assembled as shown and can accommodate about a dozen different door thicknesses as a result of the one way ratchet arrangement shown. Handle or knob portion 603 has a main cylinder 634 and a grasping flange 632.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

What is claimed is:

1. A flexible latch and handle device having an adjustable length handle, which comprises:

a) a latch component having a neck, a catch for engagement with a keeper, said catch being located at one end of the neck and a base at the opposite end of the neck, wherein said catch is cyclically moveable relative to said base by at least one mechanism selected from flexible materials and compressive materials; and, b) a handle component having a handle shape and adapted to be attached to said latch component;

wherein one of said latch component and said handle component has a fastener shaft with a plurality of first locking members, and the other. of said latch component and said handle component has a fastener shaft-receiving orifice with a plurality of second locking members corresponding to said fastener shaft first locking members to permit insertion of one into the other and to inhibit removal from one another.

2. The flexible latch and handle device of claim 1 wherein said fastener shaft locking members are male locking members and said fastener shaft-receiving orifice locking members are corresponding female locking members.

3. The flexible latch and handle device of claim 1 wherein said fastener shaft locking members are female locking members and said fastener-shaft receiving orifice locking members are male locking members.

4. The flexible latch and handle device of claim 1 wherein one of said latch component and said handle component are divided into two sections adapted to fit onto the other if said latch component and said handle component and said two sections are adapted to connect to one another so as to interlock at least one of said first locking members with at least one of said second locking members.

5. The flexible latch and handle device of claim 1 wherein said base of said latch component is flanged.

6. The flexible latch and handle device of claim 5 wherein said base includes a fastener shaft extending therefrom at right angles thereto.

7. The flexible latch and handle device of claim 5 wherein said base includes a fastener shaft-receiving orifice.

8. The flexible latch and handle device of claim 1 wherein said catch is cyclically flexible relative to said neck due to said neck having a flexible portion.

9. The flexible latch and handle device of claim 1 wherein said base includes a positioning member to prevent rotation of said latch component when installed on a door.

10. The flexible latch and handle device of claim 9 wherein said positioning member is selected from the group consisting of a centered protrusion of non-circular geometry, an off-centered protrusion, a centered recess of non-circular geometry and an off-center recess.

11. A flexible latch and handle device having an adjustable length handle, which comprises:

a) a latch component having a neck, a catch for engagement with a keeper, said catch being located at one end of the neck and a base at the opposite end of the neck, wherein said catch is cyclically moveable relative to said base by at least one mechanism selected from flexible materials and compressive materials; and, b) a handle component having a handle shape and adapted to be attached to said latch component;

wherein one of said latch component and said handle component has a fastener shaft with a plurality of one-way ratchets, and the other of said latch component and said handle component has a fastener shaft-receiving orifice with a plurality of one-way ratchets corresponding to said fastener shaft ratchets to permit insertion of one into the other and to inhibit removal from one another.

12. The flexible latch and handle device of claim 11 wherein said fastener shaft ratchets are ratchet protrusions and said fastener shaft-receiving orifice ratchets are corresponding ratchet indentures.

13. The flexible latch and handle device of claim 11 wherein said fastener shaft ratchets are ratchet indentures and said fastener-shaft receiving orifice ratchets are ratchet protrusions.

14. The flexible latch and handle device of claim 11 wherein said ratchets of said fastener shaft and of said fastener shaft-receiving orifice are combinations of both ratchet protrusions and ratchet indentures.

15. The flexible latch and handle device of claim 11 wherein said base of said latch component is a flange.

16. The flexible latch and handle device of claim 15 wherein said flange includes a fastener shaft extending therefrom at right angles thereto.

17. The flexible latch and handle device of claim 15 wherein said flange includes a fastener shaft-receiving orifice.

18. The flexible latch and handle device of claim 11 wherein said catch is cyclically flexible relative to said neck due to said neck having a flexible portion.

19. The flexible latch and handle device of claim 11 wherein said base includes a positioning member to prevent rotation of said latch component when installed on a door.

20. The flexible latch and handle device of claim 19 wherein said positioning member is selected from the group consisting of a centered protrusion of non-circular geometry, an off-center protrusion, a centered recess of non-circular geometry and an off-center recess.

* * * * *